US006497045B1

(12) United States Patent
Forgani

(10) Patent No.: US 6,497,045 B1
(45) Date of Patent: Dec. 24, 2002

(54) HAND HELD LOOP CUTTER

(76) Inventor: Tarek A. Forgani, 8700 Misty Hollow La., Chattanooga, TN (US) 37421

( * ) Notice: Subject to any disclaimer, the term of this patent is extended or adjusted under 35 U.S.C. 154(b) by 0 days.

(21) Appl. No.: 09/812,144

(22) Filed: Mar. 19, 2001

(51) Int. Cl.[7] ..... B26B 5/00
(52) U.S. Cl. ..... 30/305; 30/30; 30/337
(58) Field of Search ..... 30/304, 305, 320, 30/337, 339, 329, 287

(56) References Cited

U.S. PATENT DOCUMENTS 2,182,379 A * 12/1939 Hagan ..... 30/304

* cited by examiner

*Primary Examiner*—Douglas D. Watts
(74) *Attorney, Agent, or Firm*—Alan Ruderman; Miller & Martin

(57) ABSTRACT

A hand held loop cutting tool for cutting tufted loops of yarn projecting from a carpet includes a handle portion connected to a blade carrying housing portion carrying a blade holder having a plurality of slots for receiving a like number of blades. The blades have two cutting edges which may be secured in the holder with one of the edges projecting from the operating face of the housing. When the first edges of the blades are spent, the blade holder may be reversed within the housing to present the second set of edges. The blades themselves do not have to be removed from the holder until both cutting sets of cutting edges have been spent. A user merely needs to insert one of the first edges into each projecting loop where there are more than one projecting loop in a line of stitching and pull to cut the loop.

14 Claims, 2 Drawing Sheets

HAND HELD LOOP CUTTER

BACKGROUND OF THE INVENTION

This invention relates to a hand held device for cutting loops of pile yarn manually to form cut pile.

In the manufacture of cut pile carpets and rugs, occasionally one or more knives may break in the tufting machine and one or more rows of loops will then extend from the backing rather than the tufts of cut pile. Presently these loops are generally manually cut by a hand held pair of scissors as the carpet leaves the tufting machine. In wool pile carpet fabrics there may be a tool which has a plurality of fingers which grab the loops and pull them to either rip the loop or pull it from the backing. In either of these cases the process is inconvenient and not totally satisfactory. For example, if more than one row of loops is to be cut then a person standing downstream of the tufting machine must rapidly cut the loops in such rows, and in many cases, especially after a period of time when fatigue or boredom sets in, many of the loops may be missed. If the carpet or rug is to be tip sheared subsequently a slightly different look would appear where the loops have to be cut by the tip shearing apparatus and the carpet may, in certain circumstances, be classified as defective.

There have been other methods of cutting pile loops in the prior art, as for example, that shown in Scott, et al., U.S. Pat. No. 3,543,400 and Houghton, et al., U.S. Pat. No. 4,028,802, but the former could not function to cut loops while the carpet in being produced and the latter may cut but a single loop at a time. If more than one tufting machine knife should break, then Houghton, et al., cannot function to correct the stitches produced in more than one row.

SUMMARY OF THE INVENTION

Consequently, it is a primary object of the present invention to provide a hand held cutting tool for manually cutting pile loops projecting from a carpet or rug, the tool having a plurality of cutting members.

It is further object of the present invention to provide a hand held cutting tool for manually cutting loops of tufted pile which have failed to be cut extending from the face of cut pile fabric, the tool having a plurality of cutting members each having two cutting edges mounted so as to be readily reversed to prevent the second set of cutting edges when the first set of cutting edges have become worn.

It is another object of the present invention to provide a hand held cutting tool for manually cutting loops of tufted pile, the tool including a handle connected to a blade carrying housing in which a blade holder is positioned, the blade holder having a plurality of slots for receiving a like number of blades each of which has two cutting edges, and the blade holder being positioned within the housing in one of two selected positions to present the first or the second cutting edges selectively.

Accordingly, the present invention provides a hand held loop cutting tool for cutting tufted loops of yarn projecting from a carpet, the tool having a handle portion connected to a blade carrying housing position, a blade holder having a plurality of slots for receiving a like number of blades is positioned within the housing. Each blade has two cutting edges which may be secured in the holder with one of the edges projecting from the bottom of the housing. When the first edges of the blades are spent, the blades may be reversed within the housing merely by reversing the position of the holder to present the second set of edges. The blades themselves do not have to be removed from the holder until both cutting sets of cutting edges have been spent. In use, one merely needs to insert one of the first edges into each projecting loop where there are more than one projecting loop in a line of stitching and pull the loop to cut the same. When the cutting edges of the first set of edges is spent, the blade holder is removed from the housing and reversed in position to present the second set of cutting edges projecting from the bottom of the housing.

BRIEF DESCRIPTION OF THE DRAWINGS

The particular features and advantages of the invention as well as other objects will become apparent from the following description taken in connection with the accompanying drawings in which.

DESCRIPTION OF THE PREFERRED INVENTION

Figure 1:
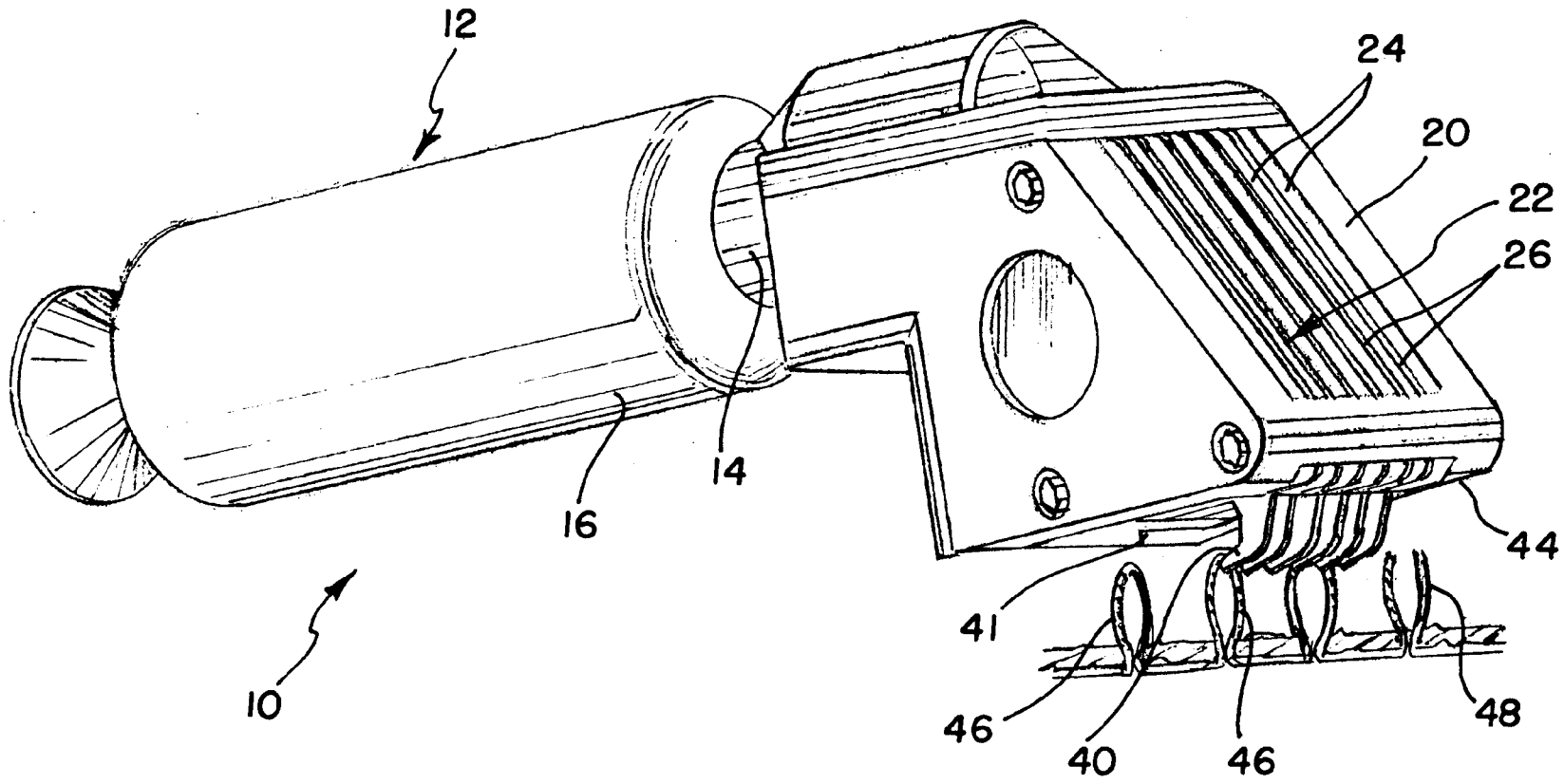
FIG. 1 is a perspective view of a hand held loop cutting tool constructed in accordance with the principles of the present invention and illustrating the manner of which a loop is cut.
Figure 2:
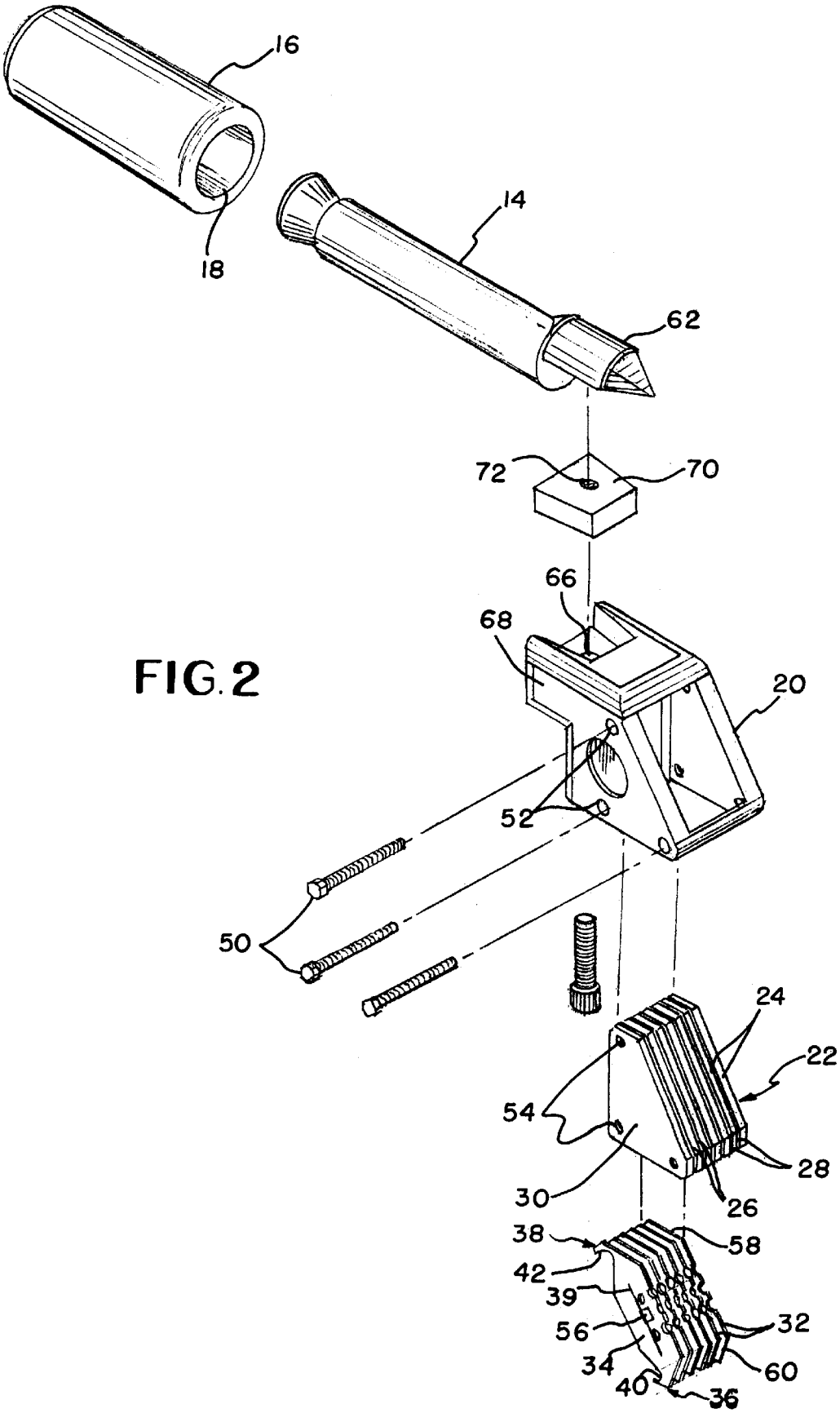
FIG. 2 is an exploded perspective view illustrating the various elements of the loop cutter formed according to the principles of the present invention.

Accordingly, FIGS. 1 and 2 show a tool 10 having a handle portion 12 including a handle shaft 14 which is equipped with a gripping portion 16 which has been slid over the handle shaft 14. In some embodiments, however, the gripping portion 16 may be made integral to the handle shaft 14. An interior surface 18 of the gripping portion 16 cooperates with the handle shaft 14 to allow movement to be imparted through the handle shaft to the housing portion 20. Preferably, the gripping portion 16 is constructed of a low slip material such as a plastic or other material that allows a user to firmly grasp the tool 10.

The housing portion 20 connects to the handle portion 14 and carries a blade holder 22, preferably within the housing portion 20. The blade holder 22 includes a plurality of plates 24 separated by slots 26. Spacers 28 may be utilized to maintain the desired spacing between the plates 24. The blade holder 22 has a somewhat triangular configuration in the form of an isosceles triangle with truncated spaces and being substantially symmetrical about a center axis 30 at the right angle as illustrated in FIG. 2 for the capabilities described below.

The blade holder 22 is configured to house a plurality of blades 32 therein. The blades 32 are also preferably symmetric about a center axis 34. The blades 32 have a first end 36 and a second end 38 with a first cutting edge 40 and a second cutting edge 42, respectively. A length along a longitudinal axis 39 separates the ends 36,38. The cutting edges 40,42 preferably take the shape of a hook to allow for the edges 40,42 to be manipulated into loops of tufted loop carpet, such as illustrated in FIG. 1.

In FIG. 1, the first cutting edges 40 of several blades 32 are illustrated extending from first operating surface 41 of the blade holder 22 and the housing 20. The cutting edges 40 extend below an operating face 44 of the housing 20 to allow the first cutting edges 40 to easily be received within loops 46, as illustrated. The second cutting edges 42, if utilized, extend beyond the second operating face (not illustrated), but for the preferred embodiment, would be similar in appearance to the first operating face 41. A loop 46 which has been cut by the tool 10 may resemble cut loop 48. Since a plurality of blades 32 are utilized by the tool 10, a plurality of loops 46 may be cut with a single stroke or motion of the tool through the carpet where the loops 46 were not cut by the tufting machine.

The blades 32 may be loaded into the blade holder 22 by inserting them through the slots 26. One method of securing the blades in the holder is provided in the preferred embodiment by using bolts 50 extending through apertures 52 in the housing and on through bores 54 in the blade holder 22. When the bolts 50 extend through the blade holder 22, they prevent the blades 22 from coming out since the three bolts contact the blades along three surfaces: a first, second and third surface 56,58,60. Other methods of securing the blades within the blade holder 22 and other methods of securing the blade holder 22 to the housing portion 20 may be readily conceived and are known in the art.

According to the presently preferred embodiment, the blades 32 have first and second cutting edges 40,42 extending beyond the first and second operating surfaces 41 (the second operating surface is obscured from view, but it is substantially similar to the first operating surface 41). The longitudinal axis 39 of the blade 32 is shown at about 45° relative to the handle portion as shown in FIG. 2. This allows the hook shaped cutting edge to be easily positioned relative to a loop 46 as shown in FIG. 1. The angle of the longitudinal axis 39 relative the handle portion could be between about 30° and 60°, more preferably between about 40° and 50° and most preferably about 45°.

The blade holder 22 of the preferred embodiment as the first and second operating surfaces 41 (not shown) substantially symmetrical about the central axis 30. Furthermore, the first and second operating surfaces 41 (not shown) are substantially located at 90° relative to one another in the preferred embodiment.

The housing portion 20 is connected to the handle portion 12 at a head 62 of the handle portion 12. The head 62 preferably accepts a connector 64 which extends through a hole 66 through a shoulder 68 of the housing portion 20. Coupler 70 may be utilized to assist in properly locating the head 62 relative to the shoulder 68 and may be configured to cooperate with the second ends 38 of the blades 32 so that the blade holder 22, when loaded with blades 32, fits correctly within the housing portion 20. The coupler 70 also has a bore 72 to receive the connector 64. The connector may cooperate with threads in the bores 66,72 as well as threads in the head 62.

With the tool 10 assembled as illustrated in FIG. 1, the operator can utilize the tool 10 until ready to swap out at least one of the blades 32. One aspect of the preferred embodiment is the ability within the blade holder 22 between two orientations to expose the first or the second cutting edges 30,38 from the respective operating face 44 of the housing 20. In the illustrated embodiment, the holder 22 is turned one hundred and eighty degrees about its central axis 30 and repositioned so that the second ends 38 of the blades are where the first ends 36 were originally. This prevents the necessity of individually changing out each of the plurality of blades 32 each time. Furthermore, it is likely that the changing of ends 36,38 will take less time than swapping out each of the blades 32.

Of course, although six blades 32 are illustrated in the figures, more or less could be utilized. Furthermore, even though the blade holder 22 may be equipped with six slots 26, all of the slots 26 need not necessarily be equipped with blades 32 at all times.

Numerous alternations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. A loop cutting tool comprising:

a handle portion with a grip;

a housing portion connected to the handle portion, said housing portion having an operating face;

a blade holder having a plurality of spaced apart slots and a first and a second operating surface, each of said slots configured to fixedly hold a portion of a blade therein while allowing a first cutting edge of the blade to extend from the first operating surface, said blade holder carried by the housing portion;

wherein the blade holder is securable in either of two orientations relative to the housing portion such that in a first orientation the first operating surface of the blade holder is secured proximate to the operating face of the housing portion, and in the second orientation, the second operating surface of the blade holder is secured proximate to the operating face of the housing portion; and at least two blades secured in the blade holder in at least two of said slots, said at least two blades having a hook shaped first cutting edge.

2. A loop cutting tool comprising:

a handle portion with a grip;

a housing portion connected to the handle portion, said housing portion having an operating face;

a blade holder having a plurality of spaced apart slots and a first and a second operating surface, each of said slots configured to fixedly hold a portion of a blade therein while allowing a first cutting edge of the blade to extend from the first operating surface, said blade holder carried by the housing portion;

wherein the blade holder is securable in either of two orientations relative to the housing portion such that in a first orientation the first operating surface of the blade holder is secured proximate to the operating face of the housing portion, and in the second orientation, the second operating surface of the blade holder is secured proximate to the operating face of the housing portion; and at least two blades secured in the blade holder in at least two of said slots having a first cutting edge and a second cutting edge substantially opposite the blade from the first cutting edge, and said second cutting edges extend beyond the second operating surface.

3. The loop cutting tool of claim 2 wherein the first cutting edge is hook shaped.

4. A loop cutting tool comprising:

a handle portion with a grip;

a housing portion connected to the handle portion, said housing portion having an operating face;

a blade holder having a plurality of spaced apart slots and a first and a second operating surface, each of said slots configured to fixedly hold a portion of a blade therein while allowing a first cutting edge of the blade to extend from the first operating surface, said blade holder carried by the housing portion;

wherein the blade holder is securable in either of two orientations relative to the housing portion such that in a first orientation the first operating surface of the blade holder is secured proximate to the operating face of the housing portion, and in the second orientation, the second operating surface of the blade holder is secured proximate to the operating face of the housing portion; and at least two blades secured in the blade holder in at least two of said slots, said at least two blades having a first cutting edge and said blades further comprising a first end and a second end with a length along a longitudinal axis there between and the first and second cutting edges are located on the first and second ends respectively, said longitudinal axis oriented at about forty five degrees relative to the handle portion.

5. The loop cutting tool of claim 1 wherein the first cutting edges extend beyond the operating face of the housing portion.

6. A loop cutting tool comprising:

a handle portion with a grip;

a housing portion connected to the handle portion, said housing portion having an operating face;

a blade holder having a plurality of spaced apart slots and a first and a second operating surface, each of said slots configured to fixedly hold a portion of a blade therein while allowing a first cutting edge of the blade to extend from the first operating surface, said blade holder carried by the housing portion;

wherein the blade holder is securable in either of two orientations relative to the housing portion such that in a first orientation the first operating surface of the blade holder is secured proximate to the operating face of the housing portion, and in the second orientation, the second operating surface of the blade holder is secured proximate to the operating face of the housing portion; and at least two of said slots, said at least two blades having a first cutting edge and said first and second operating surface oriented at about ninety degrees relative to one another.

7. The loop cutting tool of claim 1 wherein the blade holder further comprising a center axis, and the first and second operating surfaces are substantially symmetric about the center axis.

8. The loop cutting tool of claim 1 wherein the blade holder is carried substantially within the housing portion in both the first and second orientation.

9. The loop cutting tool of claim 8 wherein the blade holder is surrounded by portions of the housing portion.

10. The loop cutting tool of claim 1 wherein the blade holder is removable from the housing portion.

11. A loop cutting tool comprising:

a handle portion with a grip;

a housing portion connected to the handle portion, said housing portion having an operating face;

a blade holder having a plurality of spaced apart slots and a first and a second operating surface, each of said slots configured to fixedly hold a portion of a blade therein, said blade holder carried by the housing portion;

at least two blades fixedly held by the blade holder in respective slots, said blades having a first cutting edge extending from the first operating surface of the blade holder and a second cutting edge extending from the second operating surface; and wherein the blade holder is securable in either of two orientations relative to the housing portion such that in a first orientation the blade holder is secured to project the first cutting edges beyond the operating face of the housing portion, and in the second orientation, the blade holder is secured to project the second cutting edges beyond the operating face of the housing portion.

12. The loop cutting tool of claim 11 wherein said blade holder carried substantially within the housing portion in the two orientations.

13. The loop cutting tool of claim 11 wherein the blade holder is detachable from the housing portion.

14. The loop cutting tool of claim 11 wherein the blades further comprise first and second ends separated by a length, said first and second ends having said first and second cutting edges respectively, said length having a longitudinal axis, and said longitudinal axis oriented at about forty five degrees relative to the handle portion in the first and second orientation.

* * * * *